US007190334B2

(12) United States Patent
Kawase et al.

(10) Patent No.: US 7,190,334 B2
(45) Date of Patent: Mar. 13, 2007

(54) DRIVING METHOD AND DRIVING APPARATUS FOR A FIELD EMISSION DEVICE

(75) Inventors: Toru Kawase, Osaka (JP); Keisuke Koga, Souraku-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 499 days.

(21) Appl. No.: 10/398,700

(22) PCT Filed: Aug. 21, 2001

(86) PCT No.: PCT/JP01/07140

§ 371 (c)(1),
(2), (4) Date: Apr. 9, 2003

(87) PCT Pub. No.: WO02/33689

PCT Pub. Date: Apr. 25, 2002

(65) Prior Publication Data

US 2004/0004588 A1 Jan. 8, 2004

(30) Foreign Application Priority Data

Oct. 19, 2000 (JP) ..... 2000-319011

(51) Int. Cl.
*G09G 3/30* (2006.01)

(52) U.S. Cl. ..... 345/75.2

(58) Field of Classification Search ..... 345/74.1, 345/75.2, 76, 77; 315/169.1, 169.2, 169.3, 315/169.4, 364; 313/497, 498; 257/10; 445/24; 156/150

See application file for complete search history.

(56) References Cited

U.S. PATENT DOCUMENTS 5,294,465 A * 3/1994 Gallagher ..... 427/523
5,594,463 A 1/1997 Sakamoto
6,060,840 A 5/2000 Foo et al.
6,091,381 A 7/2000 Uenuma
6,346,773 B1 * 2/2002 Takegami ..... 315/169.1
6,743,066 B1 * 6/2004 Oguchi et al. ..... 445/6

FOREIGN PATENT DOCUMENTS

JP 11-144663 * 5/1999

* cited by examiner

*Primary Examiner*—Richard Hjerpe
*Assistant Examiner*—Abbas Abdulselam

(57) ABSTRACT

The object of the present invention is to provide a driving method and a driving apparatus for a field emission device that controls emission current with stability regardless of how long the device is driven. The field emission device driving method and driving apparatus of the present invention set the actual emission current at a reference level by adjusting the amount of current which is supplied to the emitter to a reference level. The amount of current supplied to the emitter is adjusted to the reference level by increasing the driving voltage in response to driving time elapsing in a state in which the electron emission performance is sustained above the reference level. By adjusting the amount of current supplied to the emitter in a state in which the driving voltage is sustained higher than the minimum voltage, a stable amount of emission current can be sustained and electron emission without fluctuations can be realized, even when the performance of the field emission device in emitting electrons deteriorates due to driving time elapsing.

1 Claim, 12 Drawing Sheets

DRIVING METHOD AND DRIVING APPARATUS FOR A FIELD EMISSION DEVICE

TECHNICAL FIELD

The present invention relates to a driving method and a driving apparatus for a field emission device.

BACKGROUND ART

In field emission devices, emitters are not heated as with conventional thermionic emission devices, but instead electrons are discharged by applying a strong field to the emitters. Recently research and development are being made into Field Emission Displays (FEDs) and Cathode Ray Tubes (CRTs) which use such field emission devices as a source of electron emission.

The following explains the main body and the driving circuit of a field emission device with reference to FIG. 10.

As shown in FIG. 10, a cathode 102 is formed in a thin film on one surface of a cathode substrate. An emitter 105 and an insulating layer 103 are formed on the cathode 102, and an extraction electrode 104 is in the insulating layer 103. A gate hole is formed in the extraction electrode 104 so as to expose the emitter 105.

Next, an anode 107 is formed on the surface of an anode substrate 106 that faces the cathode substrate 101.

A vacuum of approximately $10^{-6}$ Pa is generally maintained in the space between the emitter 104 and the anode 107.

The driving circuit is composed of a driving power source 109 which is connected to the extraction electrode 104, and an acceleration power source 110 which is connected to the anode 107. The cathode 102 is grounded.

The driving circuit applies a driving voltage Vex between the extraction electrode 104 and the emitter 105 in order to generate a field in the area surrounding the emitter 105, and an acceleration voltage Va between the anode 107 and the emitter 105 in order to accelerate electron emission.

FIG. 11 shows the relationship in the above-described field emission device between the driving voltage Vex and the amount of electrons emitted (hereinafter "emission current") I from the emitter 105.

The figure shows that emission of the emission current I starts when a driving voltage Vex, which is a threshold voltage Vth or higher, is applied to the extraction electrode (a point 1200 in the figure). The emission current I increases according to the solid curved line as the driving voltage Vex is increased.

When the emission current I is set to Ie, the initial operation point of the driving circuit is a point 1201 where the driving voltage Vex is V0 and the emission current I is Ie.

However, the emission current I drops as driving time t elapses, even if the driving voltage Vex is sustained at V0. As shown by the arrow, the solid curved line which shows the relationship between the driving voltage Vex and the emission current I moves to the right as the driving time t elapses. The result after a driving time t1 (for example approximately 5000 hours) is a relationship shown by the broken line. At the point where the time t1 has elapsed, the emission current I is If (a point 1202). The emission current I continues to drop as driving time t elapses.

FIG. 12 shows such a characteristic of a field emission device with driving time t on the horizontal axis and the emission current I on the vertical axis.

As described above, the emission current I drops as driving time t elapses from the initial operation point 1301, and is If after the time t1 has elapsed (a point 1302). After this point the emission current I continues to drop as driving time t elapses.

Furthermore, the emission current I is accompanied by constant low-amplitude fluctuations during driving. These fluctuations are thought to occur because the amount of electrons emitted is made unstable by a small amount of gas that remains in the electron emission space.

As described above, it is difficult to apply field emission devices whose emission current I is unstable to image display apparatuses and various other electronic apparatuses. For example, if such a field emission device is used in a color CRT, the drop and fluctuations in the emission current I cause flickering and degradation in luminosity and color fidelity.

In response to such problems Japanese Laid-open Patent Application No. H9-63466 and Japanese Laid-open Patent Application No. H8-87957 disclose techniques for stabilizing the emission current I by adding a field effect transistor (hereinafter "FET") function to the device.

However, these techniques have an effect of stabilizing the emission current I up to a certain time after the initial driving, but fail to stabilize the emission current I when the performance in emitting electrons from the emitter deteriorates beyond a certain range as driving time elapses.

DISCLOSURE OF THE INVENTION

The object of the present invention is to provide a driving method and a driving apparatus for a field emission device to control emission current with stability regardless of how long the device is driven.

In order to achieve the above-described object the present invention is a driving method for a field emission device which has an emitter and whose performance in emitting electrons from the emitter deteriorates as driving time elapses, including a first step for adjusting the performance so an amount of electrons being emitted from the emitter is higher than a reference level, by using a first adjustment factor that adjusts the performance through acting on an electrode; and a second step for setting an actual amount of electrons being emitted from the emitter to the reference level, by using a second adjustment factor to adjust energy being supplied to the emitter through an emitter circuit.

In the stated driving method the energy supplied to the emitter through the emitter circuit is adjusted in a state in which the performance of the field emission device is higher than the reference level, meaning that a stable amount of electrons can be emitted regardless of how long the device is driven. Furthermore, in this method it is possible to suppress generation of fluctuations during driving.

In the stated driving method it is desirable for the second step to adjust current that is supplied to the emitter by using a constant current characteristic in a saturation region of a bipolar transistor or a unipolar transistor.

Furthermore, in the stated driving method, even if there are fluctuations in the emission current, they can also be controlled for the above-described reasons.

Furthermore, the field emission device further includes an extraction electrode, and in this case it is desirable for the first step to include a substep of controlling the driving voltage so that the driving voltage is sustained higher than a minimum driving voltage required to emit the reference level of electrons from the emitter.

It is desirable for the first step to include a substep of counting the driving time, and in the stated substep for controlling the driving voltage it is desirable to increase the driving voltage in relation to deterioration in the performance due to an elapse in driving time.

It is desirable to detect the deterioration in the performance of the field emission device according to one of (a) a drop in the amount of electrons emitted, (b) an increase in a fluctuation width of the amount of electrons emitted, and (c) a decrease in a difference between the minimum driving voltage and the driving voltage.

When the field emission device of the present invention is used in an image display apparatus the field emission device has a layer which is made of phosphor and which opposes the emitter, and it is desirable for the driving method to include a third step for adjusting the reference level to compensate for deterioration in the phosphor due to an elapse in the driving time, based on an input image signal.

By including the stated third step, the present invention can suppress deterioration of luminosity even if the phosphor deteriorates as driving time elapses, in addition to being able to compensate for the deterioration of the performance of the field emission device as driving time elapses.

Specifically, the third step refers, each time a unit of driving time elapses, to a table in which the driving time is in correspondence with the reference level to be set to adjust the reference level.

Furthermore, the present invention is a driving apparatus for a field emission device which has an emitter and whose performance in emitting electrons from the emitter deteriorates as driving time elapses, including a first adjustment unit for adjusting the performance so an amount of electrons being emitted from the emitter is higher than a reference level, by acting on an electrode; and a second adjustment unit for setting an actual amount of electrons being emitted from the emitter to the reference level, by adjusting energy being supplied to the emitter through an emitter circuit.

The stated driving apparatus adjusts in a state in which the performance of the field emission device is above the reference level, and sets the actual amount of electrons emitted to the reference level by adjusting the energy supplied to the emitter through the emitter circuit in this state, therefore a stable amount of electrons emitted can be sustained regardless of how long the device is driven.

Furthermore, the field emission device further includes an extraction electrode, and in this case it is desirable for the first adjustment unit to be a unit for adjusting a driving voltage which is applied to the extraction electrode, the first adjustment unit to include: a part for counting the driving time, and a part for controlling the driving voltage in response to an elapse of driving time, so that the driving voltage is sustained higher than a minimum driving voltage required to emit the reference level of electrons from the emitter. It is also desirable for the second adjustment unit to adjust current that is supplied to the emitter by using a constant current characteristic in a saturation region of a bipolar transistor or a unipolar transistor.

Here, it is desirable for the second adjustment means to be formed on a main surface of a cathode substrate in an area excluding at least the main surface of the cathode substrate from a point of view of increasing production yield and driving life of the device.

The above-described field emission device driving method and driving apparatus can be applied to the following:

1. Field emission devices
2. Electron sources
3. Light sources
4. Image display apparatuses
5. Electron guns
6. Electron beam apparatuses
7. Cathode ray tubes
8. Cathode ray tube systems
9. Discharge tubes

BEST MODE OF CARRYING OUT THE INVENTION

First Embodiment

Figure 1:
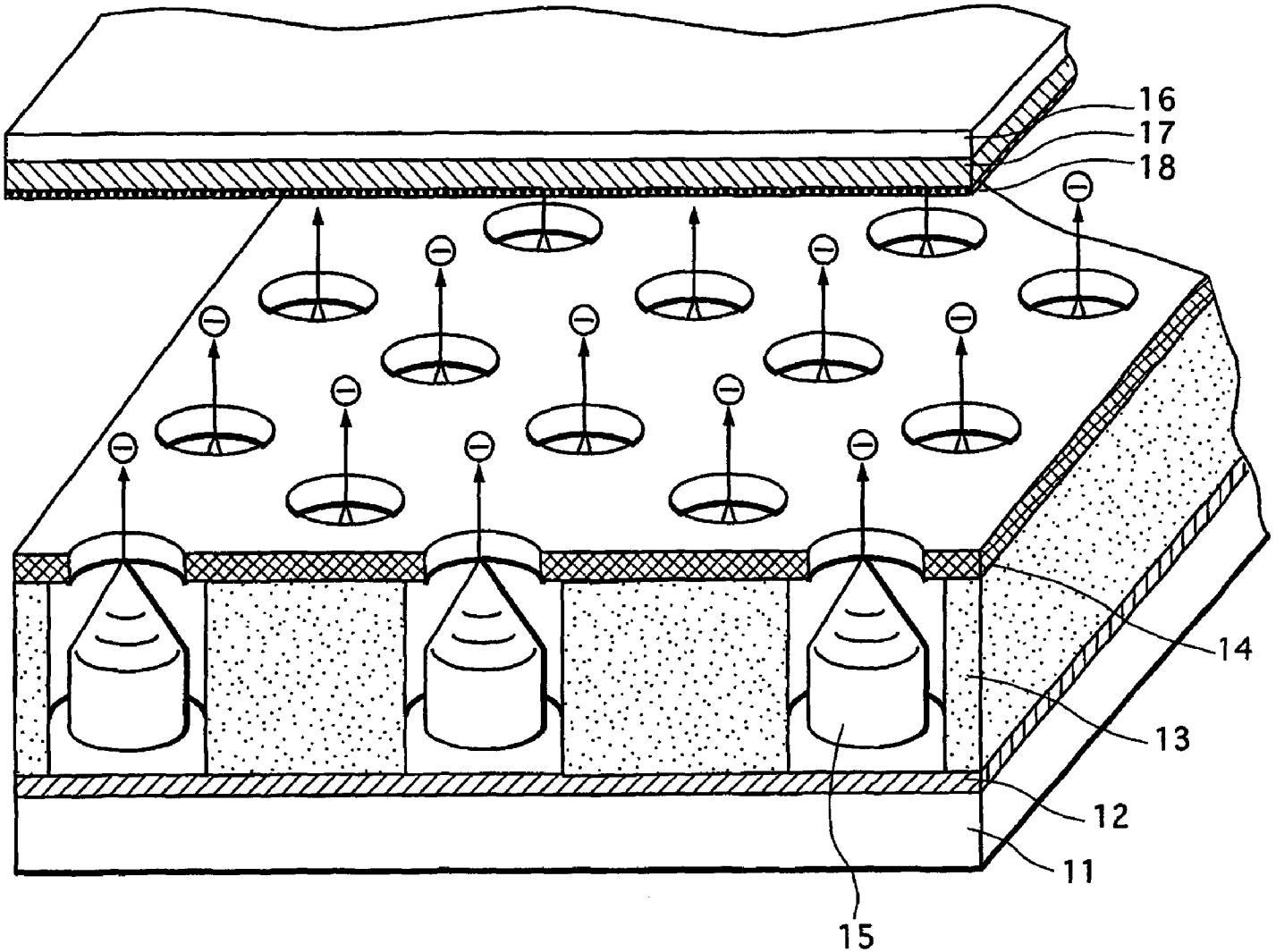
FIG. 1 is a perspective view and partial cross section of the main body of the field emission device of the present invention.

The structure of the main body of the field emission device of the present embodiment will be explained using FIG. 1. FIG. 1 is a perspective view and partial cross-section showing the main body of an image display apparatus which has a field emission device as its electron emission source.

FIG. 1 shows a cathode 12 formed in a thin film on one main surface (the top surface in the figure) of a glass cathode substrate 11. A plurality of column-shaped emitters 15 whose tip is cone-shaped are provided, and an insulating layer 13 is formed so as to surround each of the emitters 15 separately. In addition, an extraction electrode 14 which is a metal film is formed on the insulating layer 13. A plurality of gate holes are formed in the extraction electrode 14, each exposing one emitter 15.

In addition, an anode substrate 16 is placed in opposition to the emitters 15 and the extraction electrode 14. An anode 17 and phosphor 18 are formed successively on the anode substrate 16 on the surface which faces the emitters 15.

Figure 2:
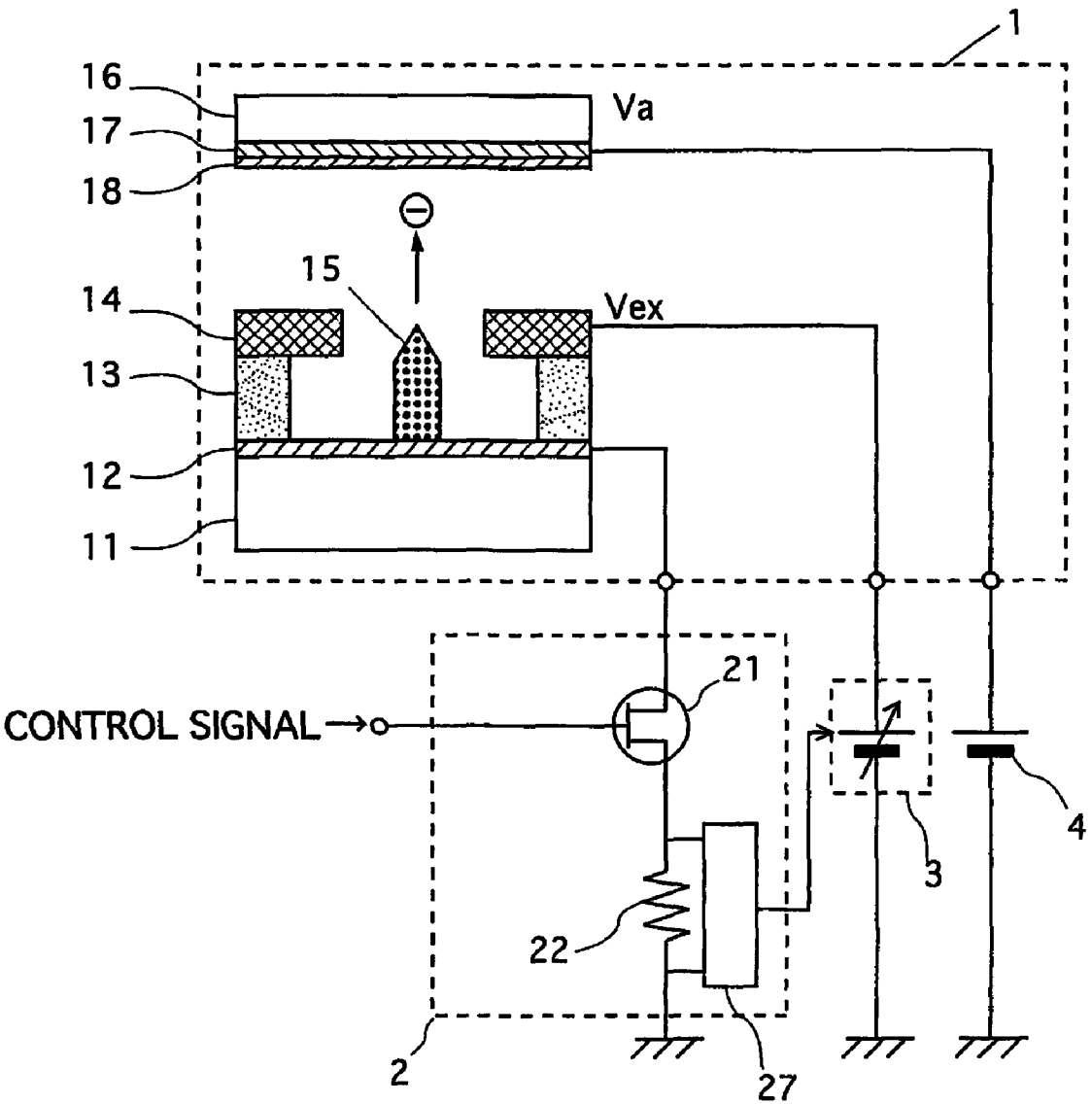
FIG. 2 shows the main body and the driving circuit of the field emission device of the present invention.

Next, the power source and control circuit which are connected to each electrode of a main body 1 will be explained using FIG. 2. FIG. 2 shows a section of the main body 1 and the driving circuit.

An acceleration power source 4 is connected to the anode 17 and performs the function of accelerating the emission of electrons from the emitter 15 in the direction of the anode 17.

A driving power source 3 is connected to the extraction electrode 14. The driving voltage Vex of the driving power source 3 is variable.

Furthermore, an electron restricting circuit 2 is connected to the cathode 12. The electron restricting circuit 2 is composed of an FET 21, a resistor 22, and a current detecting/comparing device 27. A signal detected and compared by the current detecting/comparing device 27 is applied to the driving power 3 as a signal that controls the driving voltage.

Here, the FET 21 is an n channel enhancement type MOSFET (metal oxide semiconductor field effective transistor), but is not limited to this type. The drain of the FET 21 is connected to the cathode 12, and the source is connected via the resistor 22. A control signal (control voltage Vtg) for restricting the emission current I is applied between the gate and the source of the FET 21.

In the present embodiment the electron restricting circuit 2 is not formed on the cathode substrate 11, but is instead is separate. Providing the electron restricting circuit 2 separately allows for greater yields in manufacturing and also for a longer life for the device because only the FET needs to be replaced if the FET breaks down during driving.

Figure 3:
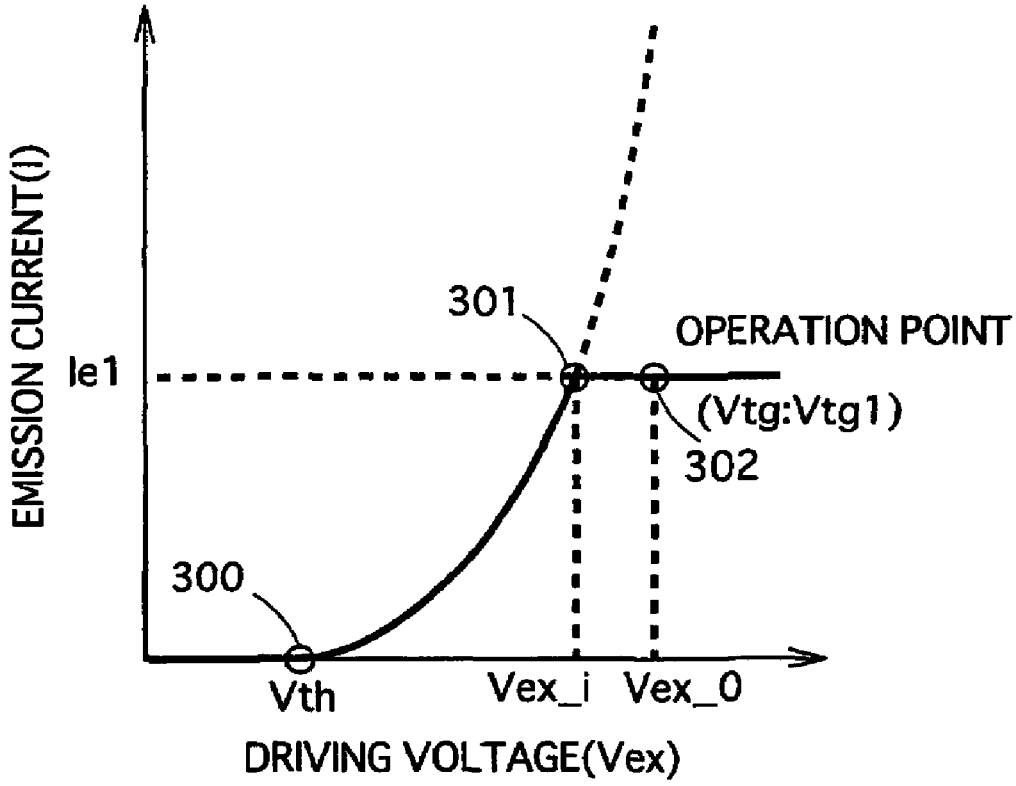
FIG. 3 shows the relationship between the driving voltage of the field emission device of the first embodiment of the present invention.

The driving method for the field emission device is explained using FIG. 3. FIG. 3 shows the relationship between the driving voltage Vex and the emission current I when the control voltage Vtg which is applied between the gate and the source of the FET 21 is a constant value Vtg1.

The extraction electrode 14, by having the driving voltage Vex applied, generates a field I the vicinity of the cone-shaped tips of the emitters 15.

As shown in the figure, electrode emission from the emitters 15 starts when the driving voltage Vex exceeds the threshold voltage (Vth) (point 300). Furthermore, as the driving voltage Vex increases, the emission current I increases as shown by the curved solid line in the figure, but when the driving voltage Vex reaches Vex_i (point 301) the emission current I is constant at Ie1, a reference level. This is because the FET 21 has a constant current characteristic in a saturation area (pinch off area) according to a driving voltage Vex_1 or higher which is applied between the drain and the source. Therefore, the current which flows between the drain and the source due to the control voltage Vtg1 which is applied between the gate and the source is limited to a fixed value Ie1.

The driving method of the present invention is characterized in that it makes the point 302 where the driving voltage Vex is Vex_0 and the emission current I is Ie1 the operation point.

Figure 4:
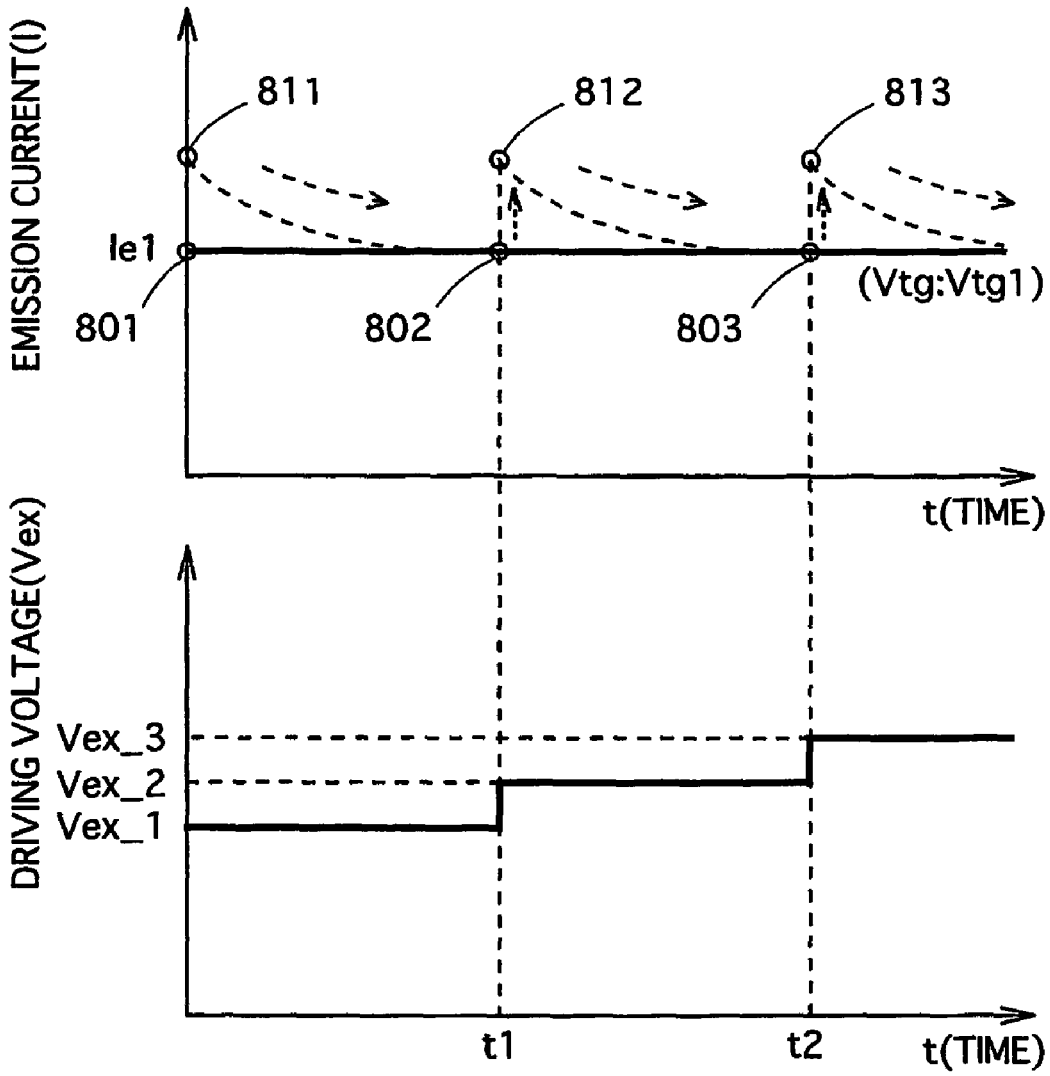
FIG. 4 is for explaining the driving method of the field emission device of the first embodiment of the present invention.

Deterioration of the performance in emitting electron emissions from the emitter with the lapse of driving time is as explained above. The following explains the driving method of the present embodiment in response to this deterioration, using FIG. 4.

The emission current I shows a set value Ie1 at the initial driving when the control voltage Vtg is Vtg1 and the driving voltage Vex is Vex_1 (point 801). A point 811 in the figure shows an operation point of a conventional field emission device which does not have electron current restricting circuit 2. In other words, the difference in the emission current I between points 811 and 801 is the amount of electrons being restricted by the electron restricting circuit 2 in initial driving.

When the performance in emitting electrons from the emitter drops with the elapse in driving time, the emission current I in a device which does not have an electron restricting circuit 2 drops in a manner such as that shown by the broken line. However, the device in the present embodiment, as shown by the straight solid line, does not fluctuate. In other words, in the driving method the present embodiment the actual amount of electrons emitted from the emitter does not drop even if the electron emission performance deteriorates as driving time elapses.

In such a state a point 802 where the difference between the broken line and the solid line in the figure disappears occurs when the driving time further elapses reaches a point where a time t1 has elapsed. The time t1 varies according to settings, but is for example approximately 4000 to 5000 hours. If driving continues with the driving voltage Vex being Vex_1 after the point 802, the current that flows between the drain and the source of the FET 21 goes beyond the control range according to the constant current characteristic. Therefore, the emission current I becomes less than Ie1 according to the deterioration in the performance in emitting electrons from the emitters, and fluctuations occur.

Therefore, the present embodiment has a structure in which the value of the current which flows between the drain and the source of the FET 21 is detected by the current detecting/comparing device 27, this value is compared with the required current value and detected at point 802, and a signal which increases the voltage is sent to the driving power source 3. The driving power source 3, on receiving a signal that the operation point 802 has been reached, increases the voltage value Vex to a driving voltage Vex_2 automatically. This voltage value Vex_2 is a value preset so as to compensate for the drop in the performance in emitting electrons from the emitters, and is set so that the difference in the emission current I between the points 812 and 802 is equivalent to the difference at initial driving. This is the same for Vex_3 also. Such a method allows the emission current I to be sustained at Ie1 without fluctuations even if the performance in emitting electrons from the emitters deteriorates as driving time elapses.

In the above explanation the current which flows between the drain and the source of the FET 21 is used for the detecting at the point 802, but it is possible to detect the current flowing through the anode 17.

Please note that the points 802 and 803 in the diagram where the driving current Vex is increased are shown merely as examples, and the increases are not limited to occurring at these points.

Furthermore, a method may be used by which the points 802 and 803 are determined by pre-storing a table, which includes parameters of the driving time and the performance in emitting electrons from the emitter in correspondence, is stored in the control unit of the driving power source 3 and the table is referred to each driving time t. An example of such a table pre-stored in the control unit of the driving power source 3 is a table such as FIG. 4 which specifies the driving voltage Vex of the driving time t as Vex_1 up to time t1, Vex_2 for t1 to t2, and Vex_3 for t2 to t3. When driving the device, the driving power source 3 control unit increases the driving voltage Vex in stages, based on the table and the driving time t which is counted by a timer.

In addition, besides the above-described method, the increasing of the driving voltage Vex may be performed by detecting a point where, according to the deterioration in the performance in emitting electrons from the emitter, the emission current I becomes less than a set value Ie 1, or make a criterion amplitude value and detect a point where the amplitude value of the fluctuations of the emission current I becomes greater than the set value.

However, the conversion rate of visible light of the phosphor 18 drops gradually as driving time t elapses. This is because the collision of electrons promotes deterioration of the phosphor 18.

Therefore, the luminance of the light emitted drops gradually even if the amount of electrons irradiated on the phosphor 18 from the emitter is a constant level. Taking this into consideration, in the present embodiment, it is possible to store a table of coefficients which are multiplied with the control voltage Vtg, and multiply the coefficient which corresponds to each driving time t with the control voltage Vtg so that the luminance is maintained at a constant level. For example, the visible light conversion rate for each driving time may be measured in advance and a table made in which the driving time t and the coefficient (inverse of the conversion rate) are put in correspondence. In this kind of driving method, the deterioration of luminance of the device can be suppressed even if the visible light conversion rate of the phosphor 18 drops with the elapse of driving time.

Second Embodiment

Figure 5A:
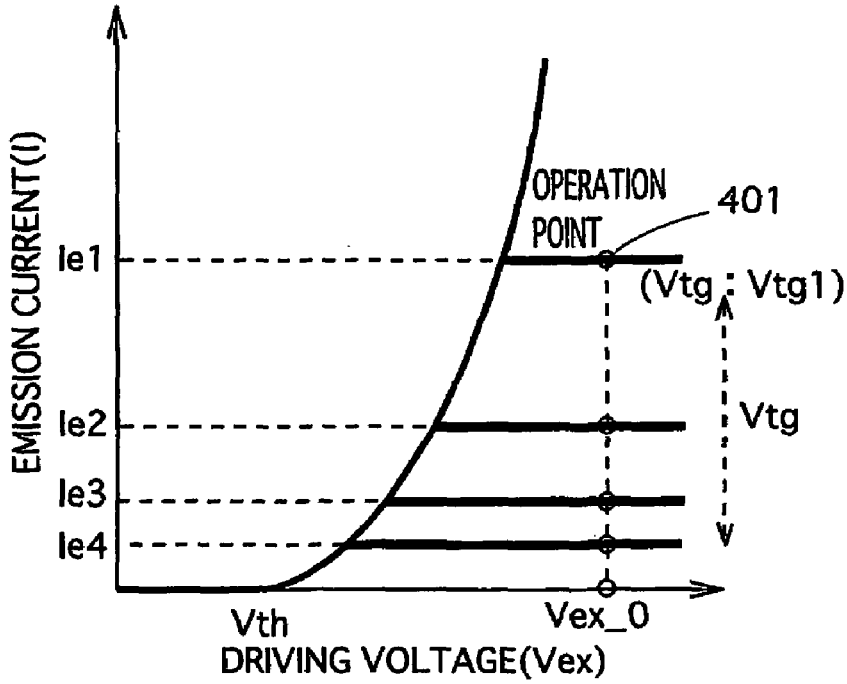
FIGS. 5A and 5B are for explaining the driving method of the field emission device of the second embodiment of the present invention.
Figure 5B:
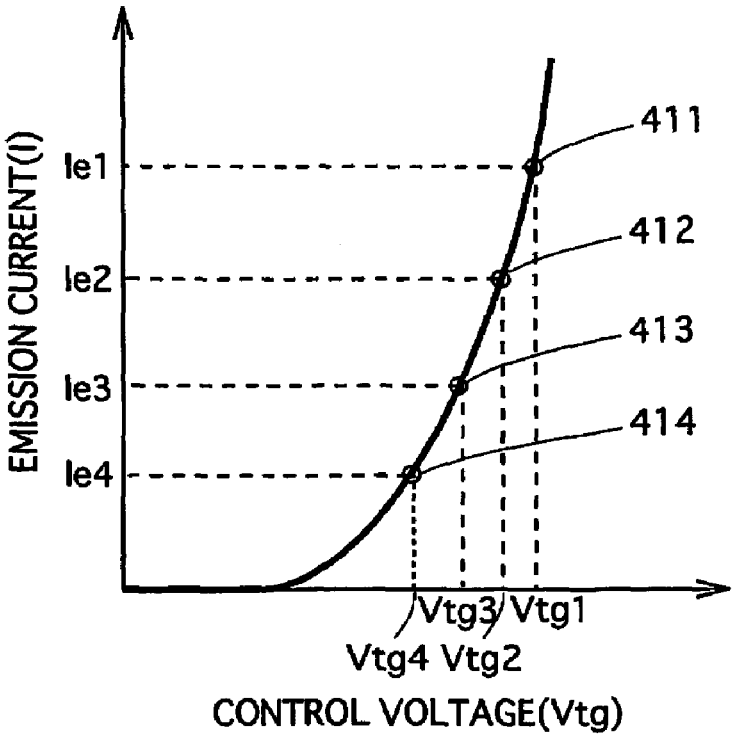

In the above-described first embodiment the control voltage Vtg which is applied between the gate and source of the FET 21 is a set value Vtg1, but in the present embodiment a method in which the emission current I is fluctuated by operating the control voltage Vtg is explained using FIG. 5A and FIG. 5B.

Please note that in the present embodiment the structure and the main body 1 of the field emission device and the driving apparatus are the same as the above described FIG. 1 and FIG. 2.

FIG. 5A shows the relationship between the driving voltage Vex and the emission current I. The initial operation point of the driving apparatus is set as point 401 where the driving voltage Vex is Vex_0 and the emission current I is Ie1. Here, the control voltage Vtg applied between the gate and the source of the FET 21 is Vtg1.

FIG. 5B shows the relationship between the control voltage Vtg and the emission current I. The above-described initial operation point is shown by a point 411.

In this way, while the driving voltage Vex is sustained at Vex_0, the control voltage Vtg is changed to Vtg2, to Vtg 3, and then to Vtg 4. With each change the emission current I changes to Ie2 (point 412), to Ie3 (point 413), and to Ie4 (point 414) respectively. The applied driving voltage Vex_0 must be sufficient to sustain the set current characteristic in the FET 21.

Furthermore, the driving voltage Vex is increased to compensate for the deterioration in the performance in emitting electrons from the emitter with the elapse of driving time, as explained in the first embodiment.

Therefore, in the driving method of the present embodiment, the emission current I can be set at a predetermined value by operating the control voltage Vtg which is applied between the gate and the source of the FET 21. Ordinarily a voltage between 0 and 5 volts is sufficient as the voltage which is applied between the gate and source of the FET 21, making control at low voltage possible compared to when the emission current I is controlled by directly changing the driving voltage Vex which is dozens of volts. This means that the present driving method superior in that spike noise is not generated when the control voltage is fluctuated.

However, as can be seen from FIG. 5B, the control voltage Vtg and the emission current I are not proportionate. Therefore, when the emission current I is to be controlled to a certain value, it is necessary to grasp the relationship between the control voltage Vtg and the emission current I and then change the control voltage Vtg accordingly.

Figure 6A:
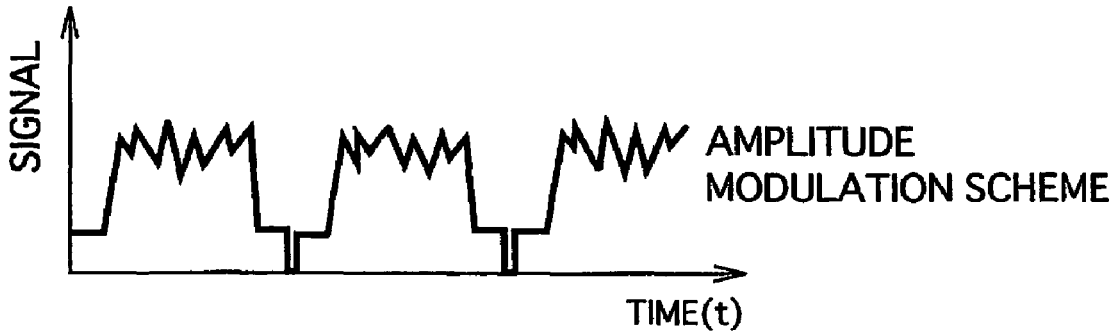
FIGS. 6A, 6B, and 6C are wave diagrams showing a luminance signal.
Figure 6B:
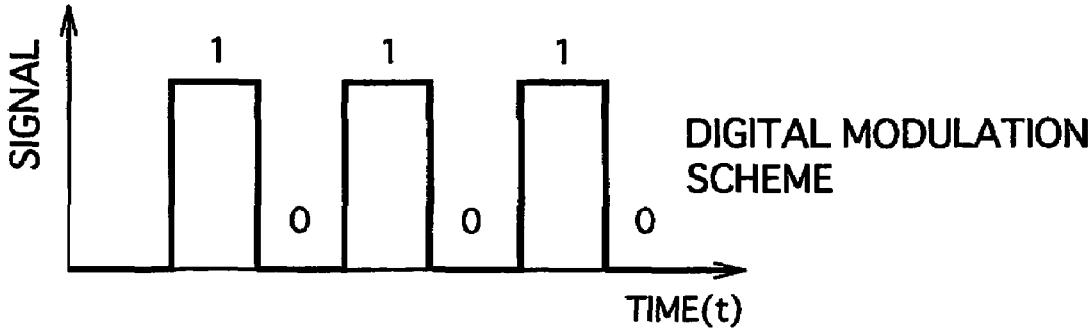
Figure 6C:
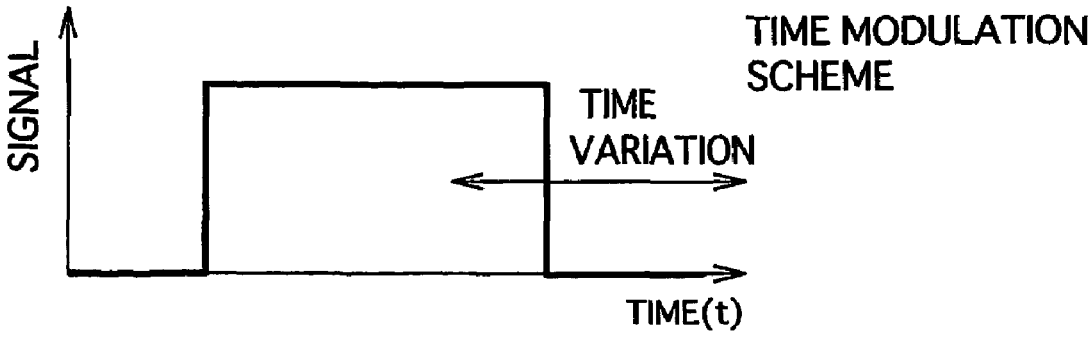
Figure 7A:
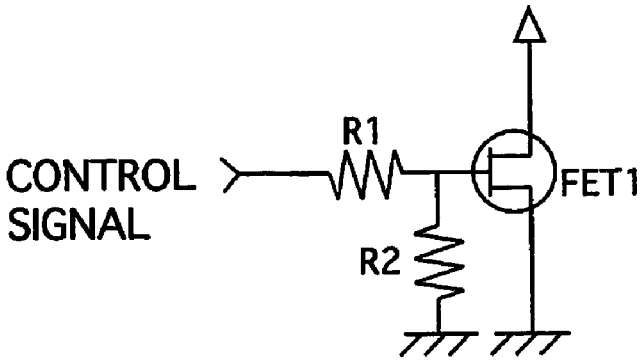
FIGS. 7A, 7B, and 7C each show an electron restricting circuit connected to the cathode of the field emission device.
Figure 7B:
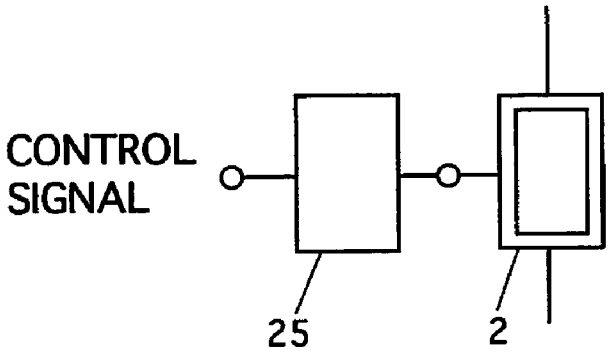
Figure 7C:
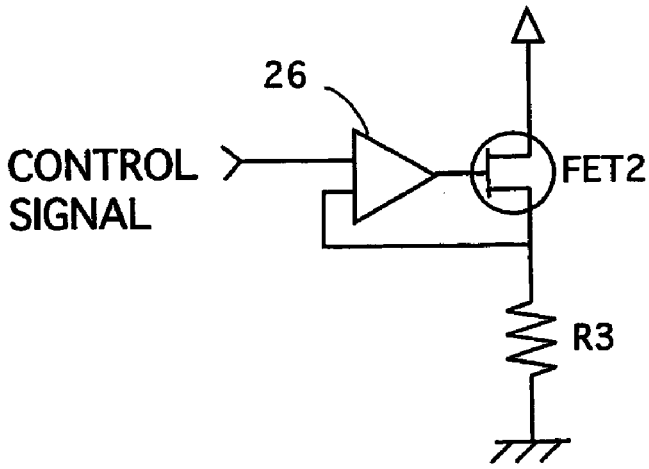

Next, FIGS. 6A, 6B, and 6C, and FIGS. 7A, 7B, and 7C will be used to explain adding a luminance signal to the FET 21 gate, considering characteristics such as those shown in FIG. 5B. FIGS. 6A, 6B, and 6C show schematic wave diagrams of typical luminance signals. FIGS. 7A, 7B, and 7C show examples of the electron restricting circuit 2.

Examples of modulation schemes for luminance signal are an amplitude modulation scheme in FIG. 6A, a digital modulation scheme in FIG. 6B, and a time modulation scheme in FIG. 6C. The amplitude modulation scheme signal is a video signal from, for instance, representative video. In this method the signal amplitude is modulated so as to correspond to the amplitude of the modulation wave.

In the digital modulation scheme, the signal has either a value 1 (ON) or a value 0 (OFF). In the time modulation scheme, the signal has either a value 1 (ON) or a value 0 (OFF) and the time width of the wave is changed when the value of the signal is 1 (ON).

The electron restricting circuit has a FET 1, and resistors R1 and R2 for applying a signal. There is no problem when a signal which can have two values such as in the above-described digital modulation scheme and time modulation scheme is applied. However, when the amplitude modulation scheme signal of FIG. 6A is applied the problem arises that the emission current I and the control signal Vtg are not proportionate in the circuit.

An electron restricting circuit such as that shown in FIG. 7B can be used with a amplitude modulation scheme luminance signal such as that in FIG. 6A. This circuit has a signal correction circuit 25 added to the signal input side. The signal correction circuit 25 performs correction when an amplitude modulation scheme signal is input so that the current output from the electron restricting circuit 2 is proportionate to the amplitude of the input signal.

FIG. 7C shows a specific example of a circuit. The circuit is a refernece constant current circuit, and is composed of an FET 2, a detection resistor R3, and a operational amplifier (hereinafter "op amp") 26. In the circuit the current which flows between the source and the drain of the FET 2 is converted to a voltage value in the detection resistor R3, and the circuit operates so that the voltage value and the input voltage value are equivalent. Accordingly, such a setting makes the current which flows through the detecting resistor 3 (substantially equivalent to the current that flows through the FET 2) and the amplitude of the control signal proportionate.

Therefore, even when an amplitude modulation scheme signal is input into a field emission device having the above-described circuit, the result is that the emission current I and the input signal are proportionate.

Please note that in the above an op amp 26 is used in the signal correction circuit 25, but the signal correction circuit 25 is not limited to having the op amp 26, and another structure which results in an input luminance signal and the emission current I being proportionate is possible. For example, a table showing the input luminance signal in relation to the emission current I may be stored in the signal correction circuit 25 and the luminance signal corrected based on this table. Alternatively, an device which outputs an inverse characteristic may be connected.

Third Embodiment

Next, the field emission device of the present invention will be explained when it is applied to a CRT as the power source, using FIG. 8.

Figure 8:
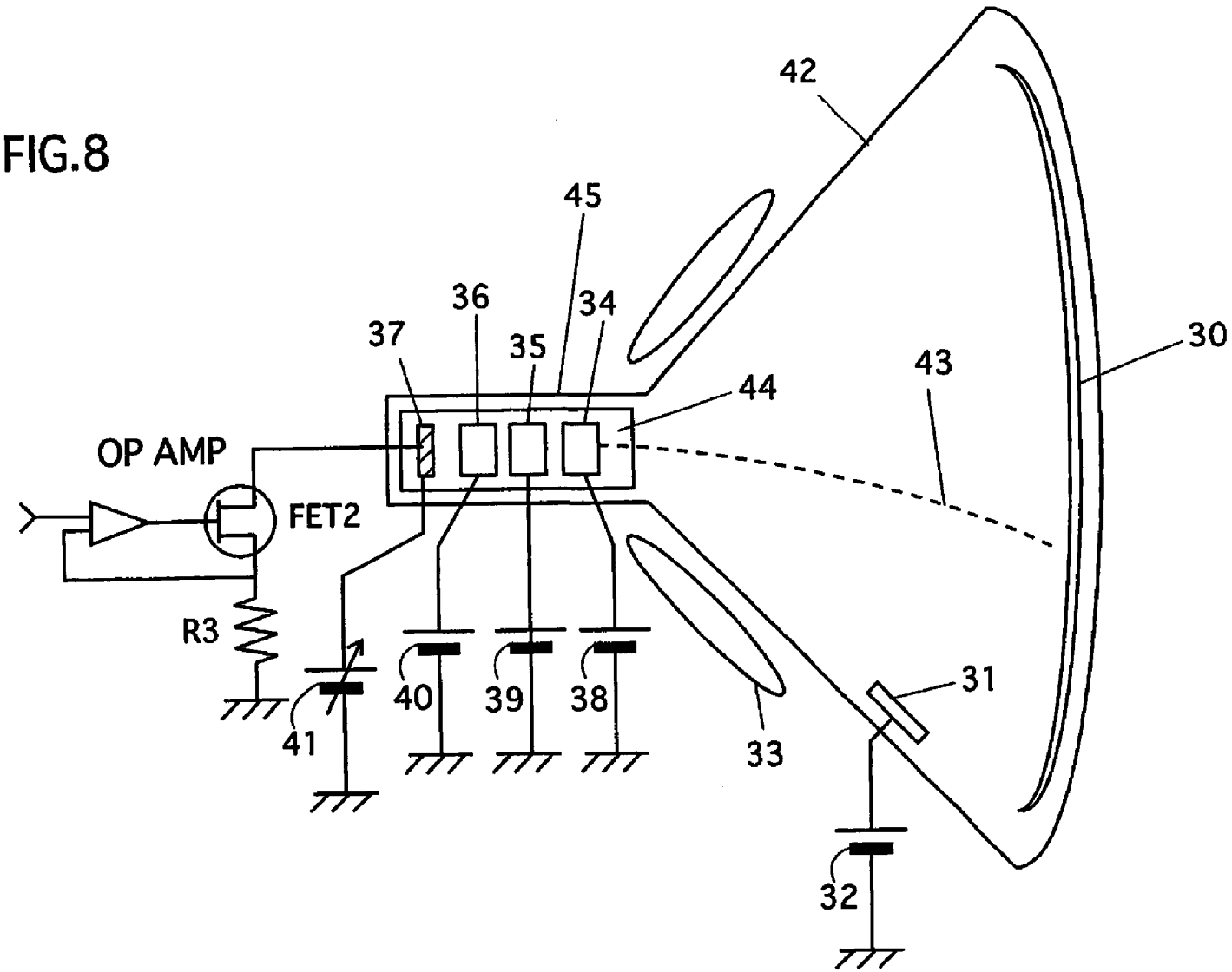
FIG. 8 shows the construction of the picture tube of the third embodiment of the present invention.

As shown in FIG. 8 a field emission device 37 is provided inside an electron gun 44. The electron gun 44 is composed of a first electrode 36, a second electrode 35, and a third electrode 34, and is provide in a neck 45. The neck 45 is joined to a funnel 42.

The first electrode 36, the second electrode 35, and the third electrode 34 are connected to power sources 40, 39, and 38 respectively.

The extraction electrode of the field emission device 37 is connected to a driving power source 41, and the cathode is connected to the electron restricting circuit. The electron restricting circuit has the same structure as the circuit shown in FIG. 7C, and is positioned on the outer part of the neck 45. An amplitude modulation scheme video signal is input into the FET 2 gate via the op amp.

In this CRT an electron beam 43 discharged from the electron gun 44 is deflected by a deflection coil 33 which is provided on the funnel 42, and is displayed as an image on hitting a phosphorous surface 30. The electrons which hit the phosphorous surface 30 flow from an anode 31 to an anode power source 32.

The driving method for the CRT is the same as that in the first and second embodiments. Although not illustrated, the driving voltage Vex which is applied by the driving power source 41 to the extraction electrode is higher than the voltage required to discharge a necessary amount of electrons from the device, and is sufficient for the FET 2 to have a constant current characteristic. A table which corresponds the driving time and the driving voltage Vex is stored in the driving power source 41, and, considering the deterioration of the phosphor on the phosphor surface 30, a table of coefficients which are multiplied with the video signal is stored in advance in the electron restricting circuit. During the driving of the CRT, the two tables are referred to each driving time t, and increases in the driving voltage Vex, and the coefficients which are multiplied with the video signal are adjusted. The timing with which the driving voltage Vex is increased differs according to the speed of the deterioration of the performance in emitting electrons from the emitter, but this increase usually takes place approximately every 5000 hours. Furthermore, the coefficients which are multiplied with the video signal are determined in correspondence with the driving time t.

Therefore, the CRT of the present embodiment can maintain a high level of luminance despite a drop in the performance in emitting electrons from the emitter and the deterioration of the phosphor due to the elapse of driving time.

Furthermore, the CRT is superior in that it allows for a high yield in manufacturing because the electron restricting circuit is formed on the outer part of the neck. This is because such a structure avoids problems such as deterioration in performance that occurs in a heating process, and breakage by static electricity due to sparking during an insertion procedure, that may occur if the electron restricting circuit is formed inside the neck 45.

In addition, the CRT of the present embodiment can prolong the life of an apparatus because only the broken part need be replaced if the election amount restricting circuit breaks during driving.

Please note that in the present embodiment the luminance is maintained using the driving time t and the above-described tables, but the method of maintaining luminance is not limited to this. For example, a method such as that in the first and second embodiments in which the detected emission current I is used is possible.

Fourth Embodiment

Figure 9:
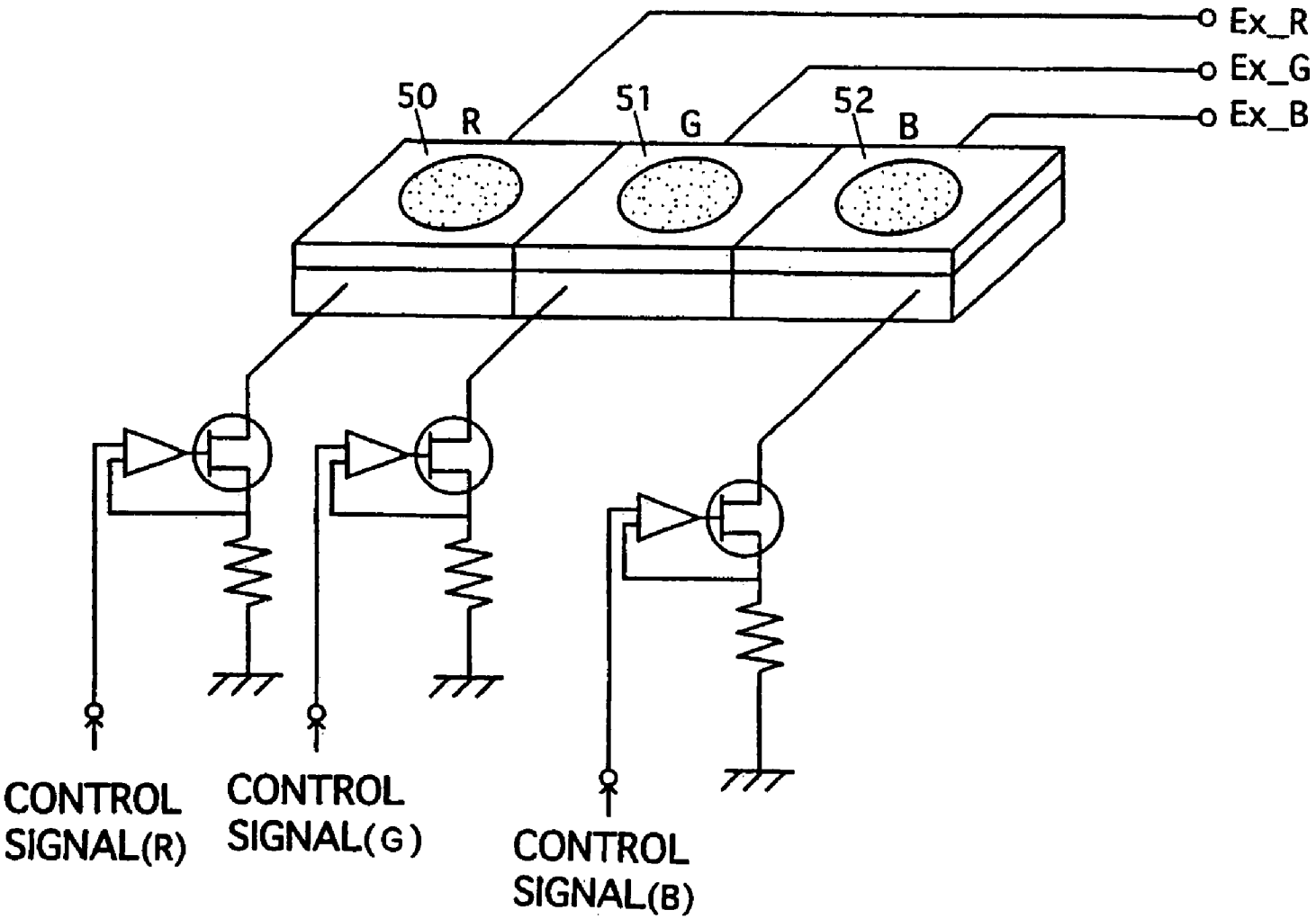
FIG. 9 shows the construction of the picture tube of the fourth embodiment of the present invention.
Figure 10:
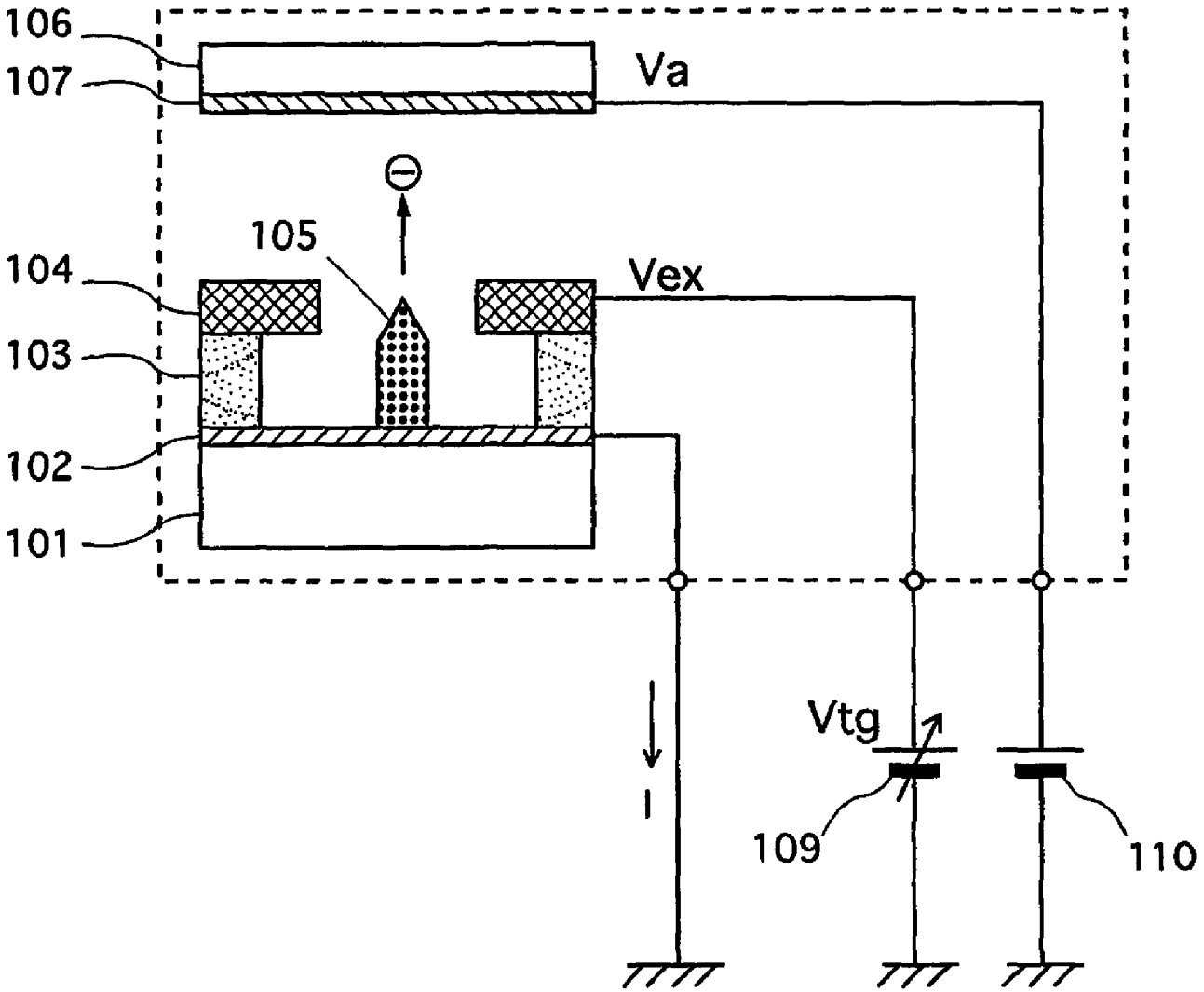
FIG. 10 shows the main body and the driving circuit of a conventional field emission device.
Figure 11:
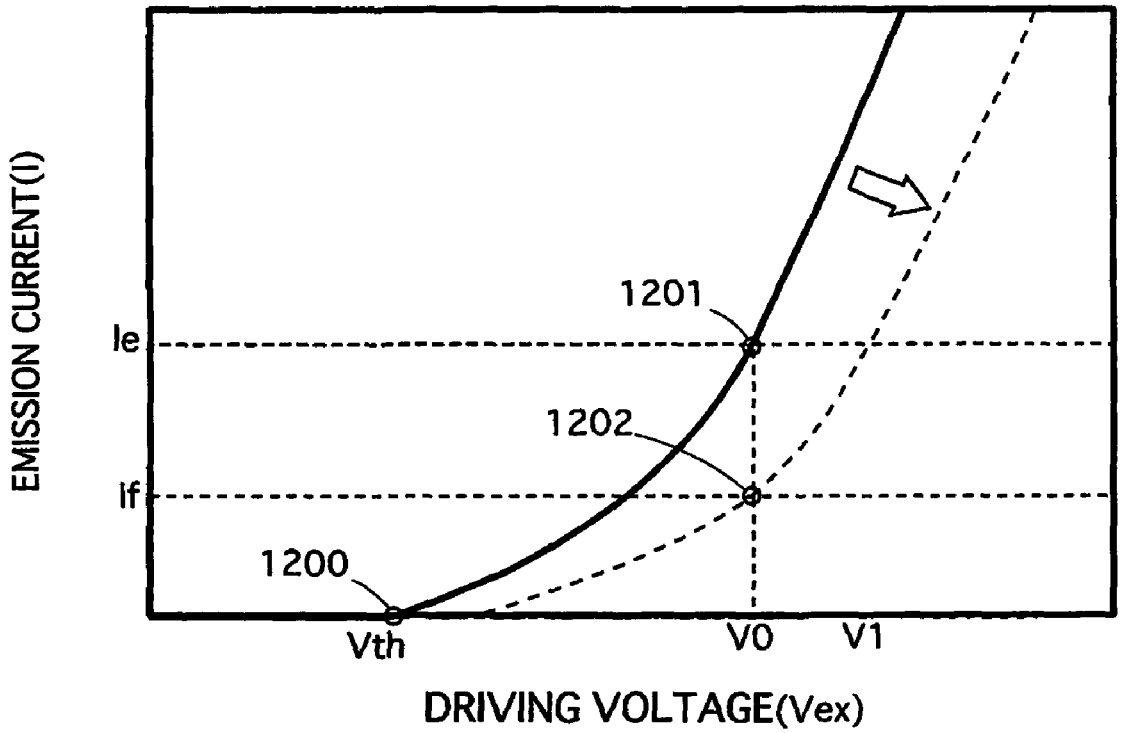
FIG. 11 shows the relationship between driving voltage and emission current in a conventional field emission device.
Figure 12:
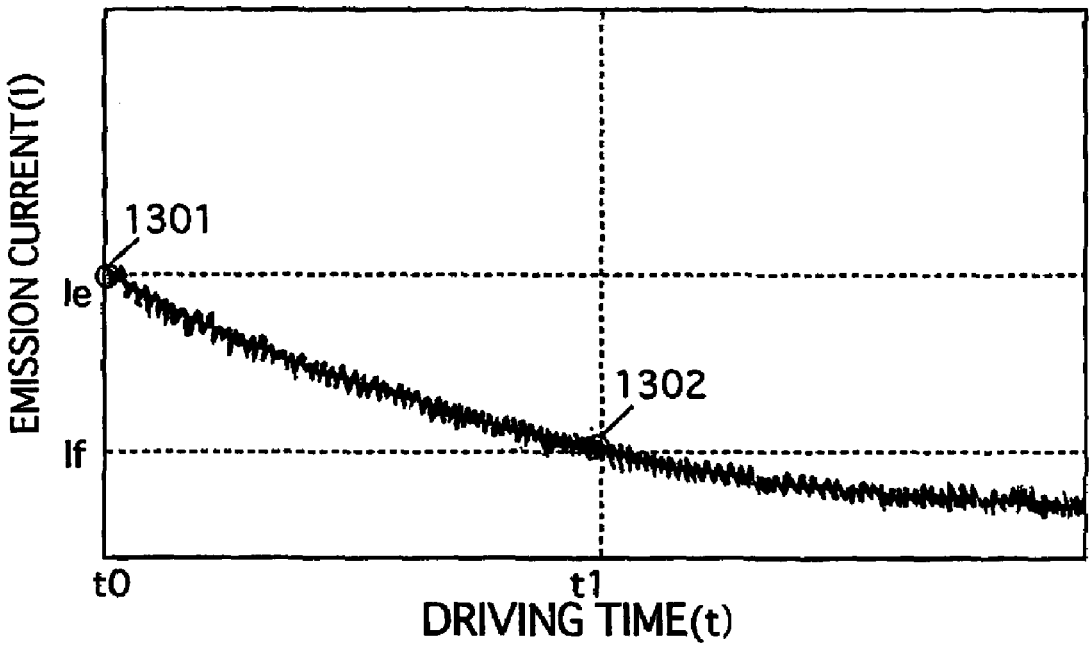
FIG. 12 shows the relationship between driving voltage and emission current in a conventional field emission device.

FIG. 9 shows the construction of a CRT apparatus that uses the field emission device of the present invention for electron emission sources for each of red (R), green (G),and blue (B).

The CRT apparatus of the present embodiment includes an electron emission source 50 for red (R), an electron emission source 51 for green (G), and an electron emission source 52 for blue (B). Each of the electron emission sources has a field emission device as its electron emission source.

The extraction electrodes of the field emission type field emission devices are connected respectively to terminals Ex_R, Ex_G, and Ex_B which are for applying driving voltage.

Furthermore, there is an electron restricting circuit connected to each cathode, in the same way as the second embodiment. Luminance signals R, G, and B are input into the FET gates of each electron restricting circuit respectively, via op amps.

Each of the driving power sources (not illustrated) connected to the terminals Ex_R, Ex_G, and Ex_B in the CRT apparatus have a pre-stored table regarding the electron emission performance of the particular device and the phosphor degradation, and adjusts the particular device while applying the relevant driving voltage Vex.

In CRT apparatuses which have a conventional field emission device, there is a problem that the white balance at initial driving is lost as driving time elapses, due to variations in the speed at which the electron emission performance of each device drops and the speed at which each color of phosphor deteriorates.

In contrast, in the CRT apparatus of the present apparatus the driving voltage Vex is adjusted while the picture tube is driven, so that the light emission luminance of each electron emission source is maintained at a constant level. Therefore, the white balance is not lost.

Furthermore, the CRT apparatus, as in the first embodiment, does not suffer from image flickering or deterioration in luminance during driving.

Other

Note that the field emission devices of the first to fourth embodiments are simply examples, and the structure, materials and so on of the present invention are not limited to those in the embodiments.

Furthermore, an example is given in the embodiments of an image display apparatus which has a field emission device as its electron emission source, but the driving method and driving apparatus of the field emission device of the present invention are not limited to this application. For example, the present invention can be applied to light sources such as fluorescent lights, image display apparatuses which perform matrix driving (FEDs an so on), electronic beam apparatuses such as electronic microscopes, cold cathode sources such as CRT systems, and discharge tubes such as plasma display panels.

INDUSTRIAL APPLICABILITY

The driving method and driving apparatus of the present invention for a field emission device are effective in realizing picture display apparatuses and light sources, in particular those of high quality.

The invention claimed is:

1. A driving method for a field emission device which has an emitter and whose performance in emitting electrons from the emitter deteriorates as driving time elapses, comprising:

a first step for adjusting the performance so an amount of electrons being emitted from the emitter is higher than a reference level, by using a first adjustment factor that adjusts the performance through acting on an electrode; and a second step for setting an actual amount of electrons being emitted from the emitter to the reference level, by using a second adjustment factor to adjust energy being supplied to the emitter through an emitter circuit, wherein the first step and second step are automatically performed after a user initiates a driving time during a service life of the field emission device.

* * * * *

UNITED STATES PATENT AND TRADEMARK OFFICE

CERTIFICATE OF CORRECTION

PATENT NO. : 7,190,334 B2
APPLICATION NO. : 10/398700
DATED : March 13, 2007
INVENTOR(S) : Toru Kawase et al.

It is certified that error appears in the above-identified patent and that said Letters Patent is hereby corrected as shown below:

On The Title Page, Item -75- should read,
(75) Inventors: Keisuke Koga, "Souraku-gun" (JP) should read --Kyoto--.

Signed and Sealed this

Twenty-ninth Day of May, 2007

JON W. DUDAS
*Director of the United States Patent and Trademark Office*